US005078061A

United States Patent [19]

Messerschmitt

[11] Patent Number: 5,078,061

[45] Date of Patent: Jan. 7, 1992

[54] DOCTOR FOR SCREEN PRINTING

[76] Inventor: Elmar Messerschmitt, Paul-Hosch-Str. 13, 8000 Munchen 60, Fed. Rep. of Germany

[21] Appl. No.: 687,066

[22] Filed: Apr. 18, 1991

Related U.S. Application Data

[63] Continuation of Ser. No. 495,708, Mar. 19, 1990, which is a continuation of Ser. No. 279,656, Dec. 5, 1988, Pat. No. 4,957,045.

[30] Foreign Application Priority Data

Apr. 16, 1988 [DE] Fed. Rep. of Germany ..... 3812826

[51] Int. Cl.[5] ..... B41F 15/44

[52] U.S. Cl. ..... 101/123; 101/169

[58] Field of Search ..... 101/123, 124, 167, 169; 15/256.5, 256.51, 256.53; 118/213, 413

[56] References Cited

U.S. PATENT DOCUMENTS

| | | | |
|---|---|---|---|
| 2,313,830 | 3/1943 | Lundbye | 101/169 |
| 2,445,140 | 10/1946 | Hanington | 101/114 |
| 4,121,519 | 10/1978 | Porth | 101/124 |
| 4,216,716 | 8/1980 | Zimmer | 101/120 |
| 4,549,933 | 10/1985 | Judd et al. | 162/281 |
| 4,648,317 | 3/1987 | Bubley et al. | 101/123 |
| 4,823,161 | 4/1989 | Yamada et al. | 15/256.5 |
| 4,940,354 | 7/1990 | Holderegger et al. | 101/169 |
| 4,957,045 | 9/1990 | Messerschmitt | 101/123 |
| 8,841,854 | 6/1989 | Bubley | 101/123 |

FOREIGN PATENT DOCUMENTS

| | | | |
|---|---|---|---|
| 0099587 | 7/1983 | European Pat. Off. . | |
| 1536985 | 2/1970 | Fed. Rep. of Germany . | |
| 8423641 | 11/1984 | Fed. Rep. of Germany . | |
| 1761423 | 7/1971 | France . | |
| 6101853 | 8/1981 | Japan | 101/169 |
| 90981 | 5/1983 | Japan . | |

*Primary Examiner*—Edgar S. Burr
*Assistant Examiner*—Ren Yan
*Attorney, Agent, or Firm*—Brown, Martin Haller & McClain

[57] ABSTRACT

A doctor for screen printing comprises a doctor strip having a lip of elastic material intended to rest on the printing screen, as well as a soft or hard elastic backing arranged on one or both sides of the doctor strip, the doctor strip and the backing being clamped in a doctor holder extending across the width of the printing screen. To improve the ink distribution on the print pattern and the guiding of the scraper on the printing screen, and to provide a more satisfactory reproducible contact pressure behavior or flexural rigidity under a constant angle of incidence of the scraper, the doctor strip and the backing are laminated together over substantially their whole surface area to form a composite material with layers of two different degrees of elasticity. In one embodiment, relatively soft strips are applied to both sides of a hard elastic backing to form composite.

1 Claim, 1 Drawing Sheet

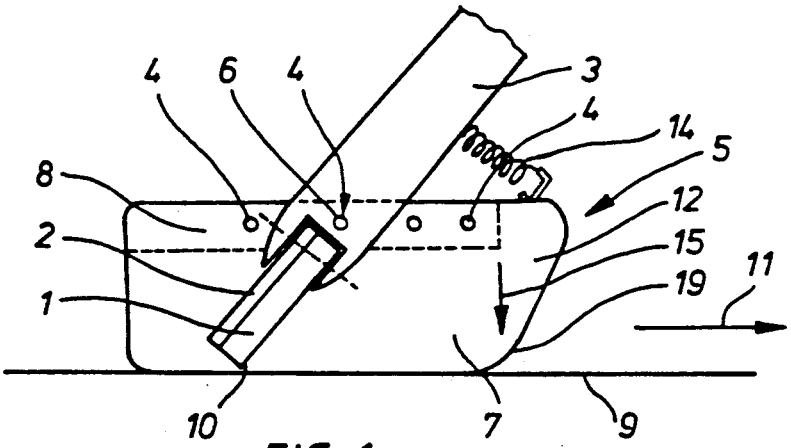
FIG 1
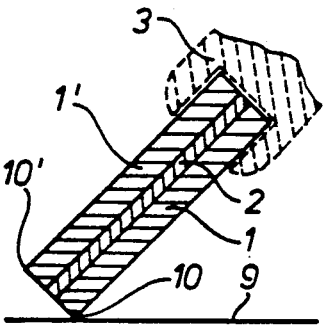
FIG 1a
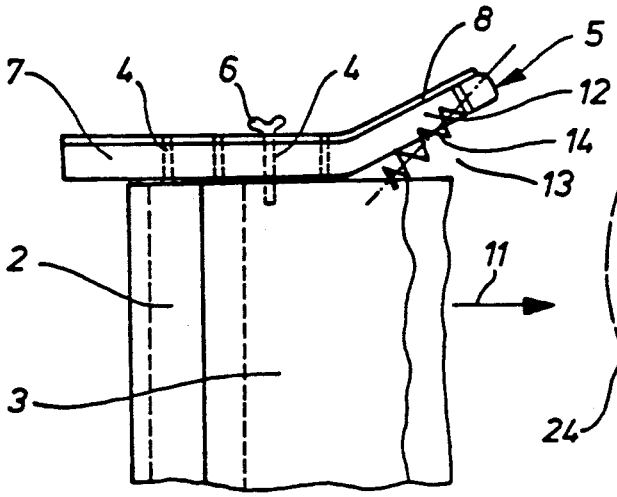
FIG 2
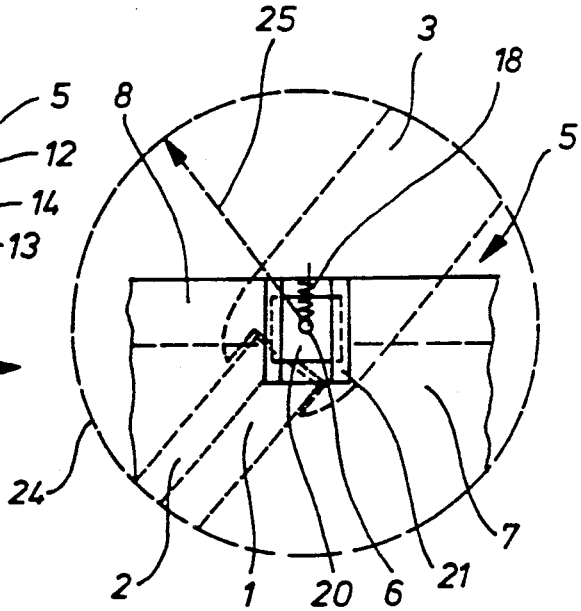
FIG 2a
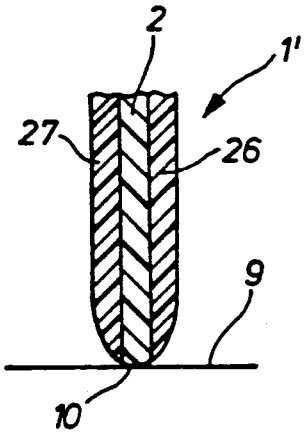
FIG 3
FIG 2b
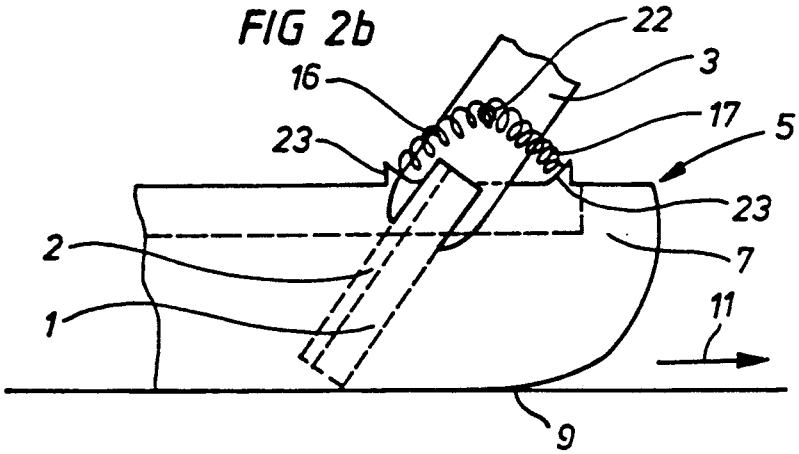

DOCTOR FOR SCREEN PRINTING

This is a continuation of application Ser. No. 07/495,708 filed Mar. 19, 1990 which was a continuation of application Ser. No. 07/279,656 filed Dec. 5, 1988, which is now U.S. Pat. No. 4,957,045, issued 9/18/90.

BACKGROUND OF THE INVENTION

The invention relates to a doctor for screen printing, for distribution of ink on a printing screen, comprising a doctor strip having a lip of soft material intended to lie on the printing screen as well as a hard elastic spacer or the like, which is situated at the rear side of the doctor strip, the doctor strip and the spacer being clamped in a doctor holder extending across the width of the printing screen.

The printing ink or dye is distributed, scraped off and pressed into the material to be imprinted, within the screen, by means of a doctor or scraper of this type. Problems arise in this connection in respect of the elastic flexing of the doctor, in order to obtain an advantageous contact pressure on the printing screen, of the angle of incidence and the uniform guiding of the doctor, and of the lip-like structure of the edge of the doctor which should be guided under precise control on the printing screen under constant pressure and angle of incidence.

DESCRIPTION OF THE PRIOR ART

A known doctor of the kind defined in the foregoing was disclosed in German Utility Model 84 23 641.8, German Patent Application 1 536 985 and European Patent 99587. In these cases the doctor strip is arranged in the manner of a contoured bar in the lower section of a hard elastic carrier rail on the one hand, or on the other hand, the doctor strip is installed in a holder comprising a number of adjacently positioned, separate and vertically displaceable holder elements. According to German Specification 1 536 985, the doctor strip is enflanked on both sides by a rubber-elastic member in the area of the doctor carrier. In this connection, it is disadvantageous that under different pressures and angles of incidence of the doctor holder, the soft bottom scraper edge on the printing screen follows on non-uniformly and non-linearly only, especially since there is a lack of uniform flexural rigidity between the doctor lip and the doctor holder.

In the case of the known arrangement of the doctor strip on a doctor holder with ambilateral enflankment of the doctor strip by an elastic element in the clamping area only, it is disadvantageous that the doctor lip itself is exposed to uncontrollable deformations.

SUMMARY OF THE INVENTION

It is an object of the present invention to construct a doctor of the type described in the foregoing, in such a way as to improve the color distribution on the coloured pattern and the guiding of the doctor on the printing screen, and as to obtain a more satisfactorily reproducible behaviour in respect of contact pressure or rather uniform flexural rigidity with a constant angle of incidence of the doctor.

This object is achieved in accordance with the invention in that the doctor strip and the attachment or spacer are joined together in the area of their overall surfaces in the manner of composite or bonded material, the doctor strip and the attachment having different degrees of elasticity and being jointly installed on the doctor holder.

The arrangement according to the invention has the advantage that flexing actions of the hard and elastic attachment are wholly transmitted uniformly and linearly to the doctor strip as well. As from the flexing section of the attachment, the lip of the doctor strip may be varied precisely as regards contact pressure and angle of incidence because of the entrainment of the doctor material as a whole.

It is immaterial in this respect whether a pressure is exercised on the doctor strip, which could otherwise lead to deformations of the doctor lip, particularly with prolonged use.

Thanks to the connection of the doctor lip or doctor strip as a whole with the attachment in the manner of bonded or laminar material comprising two or three layers, the doctor strip is repeatedly led back to its initial position because of the large-area connection. To this end, return forces operate between the attachment and the doctor strip because of the interconnection of their entire surfaces, which reach as far as the doctor lip because of the joint "grain" extension, the doctor lip in particular always being led back to its initial position.

In the case of the prior art systems comprising a spacer or attachment, provision is made in a discontinuous arrangement in which the doctor strip is either only partly installed on the attachment, or the attachment grasps the doctor strip in only the region of the doctor holder. This leads to non-linearities in the flexing diagram under faulty restoration of the doctor lip to the base position in each case, especially under protracted pressure loading on the doctor lip.

Provision is made in a preferred embodiment of the invention for the attachment or spacer to be coated on either side with doctor strips throughout its area, in the manner of a two-sided elastomer coating.

In particular, this produces a three-layer laminar material which extends without interruption into the doctor holder, a pliable glass fiber board having an approximate thickness of 1 mm being provided as a spacer.

Thanks to the use of a laminar material having two or three layers, the doctor lip may advantageously and frequently be reground, without appreciable alteration of the advantageous flexing profile, once this has been established.

Because of the advantageous elastic structure of the system, the doctor lip may furthermore always be made to follow in a specified manner. Apart from this, for example under an accidental application of excessive pressure, the original direction of the doctor lip relative to the slope of the scraper bracket is always restored, because the laminar material causes restoring forces to be generated throughout the extension of the elastic system which ensure that the scraper lip returns time and again to the original initial position in a reversible manner. In the case of the known systems, it is to be feared that in case of an accidental application of the doctor lip on the printing screen or under protracted deformations maintained for longer periods, the elastic spacer or the doctor strip itself will be deformed because the spacer and the doctor strip have discontinuities in the securing section, whereby the uniformity of its flexural rigidity is impaired.

The guiding of the doctor strip on the printing screen is improved substantially if the strip can be guided under minimum pressure, because provision is made according to the invention for retainers to press-on the printing screen particularly in the lateral areas. As regards its function the doctor should charge the printing screen with ink or dye and simultaneously scrape off printing ink too, to which end allowance should be made for distortions of the printing screen in the guiding of the doctor. The printing screen is pressed down by means of the retainers or press-on devices, precisely at the terminal portions of the doctor which are otherwise difficult to control, so that the doctor relieved to this extent may perform the task of ink distribution under advantageously low contact pressure, to reduce wear.

In a preferred embodiment, the retainers comprise a lateral vertical elastomeric plate arranged on the doctor holder via a rotational joint, having a support bar at the top edge and a rounded-off section at the end. A wear-reducing press-on action of the printing screen is advantageously obtained thereby and the ink or dye remains within the pressure pattern at the same time in the region of the functional surface of the doctor.

Further objects and advantages of the invention will become apparent from the following detailed description when read with reference to the accompanying drawings illustrating preferred embodiments of the invention.

BRIEF DESCRIPTION OF THE DRAWINGS

In the drawings:

FIG. 1 shows the sideview of a doctor according to a first embodiment of the invention with a spacer, arranged in the manner of twin-layer laminar material, in diagrammatical illustration, in a scraper bracket with lateral rotatably arranged retainers;

FIG. 1*a* shows in cross-section a second embodiment, using a three-layer laminar material, the spacer having an elastic coating on the front and rear sides;

FIG. 2 is a partial schematic plan view of a doctor system according to FIG. 1 in diagrammatical illustration;

FIG. 2*a* is a schematic illustration of different embodiments of retainers, in combination with a spring-loaded mounting of a doctor holder on a retainer;

FIG. 2*b* is a schematic illustration of a floating arrangement of the doctor holder on the retainer; and FIG. 3 shows an elastomeric doctor having a structure comprising three layers.

DETAILED DESCRIPTION OF THE PREFERRED EMBODIMENTS

A doctor strip 1 is illustrated in FIG. 1, which has a reinforcement in the form of an attachment or backing 2 which is formed as a plastics or metal plate in this embodiment. A doctor holder 3 secures the doctor strip 1 as well as the backing means 2 and the doctor holder 3 is secured on the retainer 5 by means of a tapped bore 4 on a screw 6. A retainer 5 for the printing screen 9 is arranged externally in pivotally mounted manner on each of the left and right hand sides of the doctor holder 3 or the doctor mechanism. To this end, the retainer 5 comprises a side plate 7 of an elastomer and a support bar 8, this support bar 8 being joined to the doctor holder 3 by means of a tapped bore 4 and the screw 6. The retainer 5 may be connected to the doctor holder 3 via one or more screws and, instead of the fixed attachment, a displacing mechanism may also be provided between the doctor holder 3 and the retainer 5 in the form of a micrometer adjustment means.

The doctor strip 1 and the backing 2 are combined for this purpose in the area of their overall surfaces to form a laminated material having two different degrees of elasticity. To this end, the backing 2 consists of hard elastic material and the doctor strip 1 advantageously consists of soft material, the doctor strip 1 forming an edge in the form of a lip 10 on the printing screen 9.

The backing 2 is constructed as a plastics material sheet, as a glass fiber sheet or as a plate-like metal sheet and is bonded throughout the areal extension to the doctor strip 1 by a method akin to sintering, so that a unitary composite or laminated material is formed, an increased pressure on the doctor holder 3 causing elastic deformations of the backing 2 to be advantageously transmitted to the fiber extension of the doctor strip 1, whereby it is possible to alter the angle of incidence of the doctor strip 1 on the printing screen 9 and the form of the lip 10 with precision.

A doctor is illustrated in FIG. 1, comprising a backing 2 with doctor strips 1,1' mounted on the front and rear sides, which consist of an elastomer, so that an elastic three-layer composite material is produced as a whole.

The backing 2 according to FIG. 1*a* advantageously comprises a pliable glass fiber board or sheet having a thickness of approximately 1 mm, which is coated on both sides with elastic material, so that the three-layer composite material is present with an overall thickness of approximately 5 to 12 mm. The material is chamfered in the area of the lip 10 and may advantageously be reground repeatedly, without the flexing properties being altered. Furthermore, the composite strip according to FIG. 1*a* may easily be turned, so that the lip 10' may possibly be placed in contact on the printing screen 9 with a different degree of elasticity and angle of incidence.

The three-layer composite material according to FIG. 1*a* assures a particularly advantageous application of pressure of the lip 10,10' on the printing screen with an always reproducible angle of incidence of the lip 10,10'.

The elastic strips 1,1' bear with surface contact on the hard elastic backing 2 without gaps, as far as the area of the doctor holder 3. Upon applying pressure on the doctor in the direction towards the printing screen 9, the doctor strip 1 is stretched upon flexing the backing, whereas the doctor strip 1' is compressed.

After the application of pressure, the lip 10,10' returns reversibly to the initial position, because restoring forces spring from the doctor strips 1,1' in combination with the backing 2 over their whole surface regions, which advantageously return the lip 10,10' to the base position. Accordingly, the doctor lip 10,10' is always present in a predetermined position and orientation in combination with the fixedly set slope of the doctor holder 3 even after protracted use and application of pressure, a uniform distribution thereby always being secured on the printing screen 9 in a desirable manner.

FIG. 2 shows the retainer 5 and the doctor holder 3 from above, from which it is apparent that the side plate 7 of the retainer 5 is joined to the doctor holder 3 via the screw connection 6. To this end, the device as a whole operates in the direction of pressure, i.e. in the direction of the arrow 11. So that the ink or dye collecting at the edge may be returned into the pressure area again, the retainer 5 is conically chamfered in the outward direction in a preferred embodiment, and to this end has a conically outwardly facing chamfer 12 which on its inner side 13 collects the ink and reintroduces it into the printing area. Instead of being secured on the doctor holder 3, the retainer 5 may also be fastened on the doctor mechanism which receives the doctor holder 3.

Provision is made in a development of the present invention for the retainer 5, on one side, to be rotatably mounted on its fastening, i.e. on the screw 6, and for a coiled compression spring 14 to be arranged with spacing from this rotatable mounting, which bears at the one end on the doctor holder 3 or on the doctor mechanism and at the other end on the forward end of the retainer 5, so that the forward end of the retainer 5 is thrust on to the screen 9 under spring force in the direction of the arrow 15.

Bores 4 are formed in rows in the support bar 8 of the retainer 5, whereby the doctor holder 3 is rotatably arranged on a screw 6 passing through a bore 4.

Provision is made in a development of the invention so it is not only the forward end of the retainer 5 which is resiliently thrust against the printing surface by means of a coiled compression spring 14, but that this rotatable fastening which is rigidly formed in the shape of the screw 6 in the embodiment according to FIG. 2, is also present in the manner of a spring loading device according to FIGS. 2*a* and 2*b*, i.e. with springs 16, 17, 18 acting on the rear end of the retainer 5 on to the screen 9.

To this end and according to FIG. 2*a*, the doctor holder 3 is rotatably mounted on a screw 6 on a sliding element 20 which is mounted for vertical displacement in a guideway 21 on the retainer 5 under the loading of a tension spring 18.

In an embodiment according to FIG. 2*b*, the retainer 5 is mounted in the manner of a floating attachment, pivotally on one side or resiliently on two sides on compression springs 16, 17 on a fastening point 22 of the doctor holder 3. The compression springs 16, 17 are consequently supported at bearing points 23 on the retainer 5 at one end, and at the other end on a fastening point 22 on the doctor holder 3, so that when the doctor holder 3 is led in the direction of the arrow 11, the retainer 5 is entrained and pressed on to the printing screen 9.

Instead of the said springs 14, 16, 17 and 18, use may also be made of other biassing means, e.g. such as pneumatic or hydraulic means.

It had been shown in the embodiment illustrated herein in FIGS. 1 and 2, that the retainer 5 is joined to the doctor holder 3 via a mechanical connection, or possibly also a mechanically resilient connection.

In one embodiment of the present invention, shown in FIG. 2*b*, provision is made to omit any mechanical connection between the doctor holder 3 and the retainer 5, but to install the retainer 5 directly on the doctor holder 3 itself and mount it in a resilient floating manner either pivotally on one side or on two sides on compression springs 16, 17. To this extent, the displacement of the doctor 1 itself is independent of the retainer 5.

According to FIG. 1, the retainer 5 has a rounded section 19 in the front portion, so that the insertion of the screen is facilitated. In the embodiment according to FIG. 2*a*, the retainer provided is a co-running wheel 24 which holds down the printing screen 9, being externally secured on the doctor holder 3 in either a fixed or a resiliently rotatable manner. As far as this applies, this is a rotatable mounting of the retainer 5 on the doctor holder 3, the printing screen 9 being pressed down via lateral sliding plates 7 or via entrained wheels 24. The retainers laterally arranged on the doctor holder 3 may also be constructed in the manner of a caterpillar track.

The rounded section 19 runs on to the screen 9 and prevents screen damage. Thanks to the displaceability of the retainer 5, the latter may be precisely adjusted for contact with the lateral area of the printing screen and the actual doctor strip 1 may thereby be protected against lifting-off forces originating from the screen 9.

Doctors comprising a doctor strip 1 and two doctor strips 1,1′ respectively, is illustrated in FIGS. 1 and 1*a* respectively, with a backing means 2, which together form a composite material. An ordinary conventional doctor strip may also be utilised in this case. The doctor strip or the composite material is simply inserted into the doctor holder 3 and clamped fast by means of clamping devices formed on the doctor holder 3. The elastic doctor strip 1, and 1′ respectively, is fixedly combined into a unit with the carrier or backing 2 for this purpose. The connection may for example be made by bonding between the doctor strips 1 and 1′ respectively, to opposite sides of the backing 2, to form the composite material. As an advantage, a printing operative now has the composite material available as a unitary material, in which connection the operative need no longer worry whether and how the backing had been secured at the correct spot. On the contrary, the composite material is used as a unitary material which has an advantageous flexural rigidity and considerable lip elasticity.

An advantage now arises from the fact that flexing displacement of the backing also acts linearly on the fiber extension of the doctor strip, because of the overall configuration of the doctor strip and backing as a composite material.

FIG. 3 shows a three-layer structure of a doctor 1′ of the type corresponding to FIG. 1*a*. This embodiment however clearly demonstrates the special advantages of such a three-layer structure 2, 26, 27.

It is assumed in the case of this embodiment that all three layers 2, 26, 27 comprise an elastomeric plastics material. The layers are joined together directly, if possible without interposition of an adhesive, either by an injection casting method or a centrifugal casting method.

Two different possibilities arise in this connection:

1. the central layer (marked as backing 2) can be compararively hard and elastic and the two outer layers soft and elastic, or 2. the central layer (backing 2) can be soft and elastic and the two outer layers 26, 27 hard and elastic.

The advantage exists in both embodiments that in the case of the round (or angular) ground edging of the doctor lip 10′ shown in FIG. 3, said lip always has the elasticity of the central layer (backing 2). This doctor lip 10′ is then supported on both sides by the two outer layers 26, 27. These layers 26, 27 thereby endow the doctor lip 10′ with the hard or soft elastic rigidity required in each case on the basis of their own hard or soft elastic rigidity. The properties of the material are not lost thereby, even in the case of an optionally repeatable grinding operation on the doctor 1′. Beyond this, the doctor may simply be reversed after wearing down on one side. This means that if the layer 26 had been lying at the front in the direction of the arrow 11, the doctor 1′ is turned around through 180° and the layer 27 then lies at the front in the direction of the arrow 11. The doctor 1' is thereby endowed with a doubled service life.

What is claimed is:

1. A doctor for screen printing, comprising a doctor strip layer with an edge for contact on a printing screen, and an elastic backing layer, said doctor strip and elastic backing layers being directly bonded together in face to face contact over at least substantially the whole of their surface area to form a composite material with no intervening material between the layers, the doctor strip and elastic backing layers each consisting of an elastomeric plastic material only the backing layer being of a material having a substantial hardness compared to the doctor strip layer, the doctor strip layer being relatively soft and comprising means for being elastically deformed against a printing screen on application of pressure to the blade to follow and contact the contour of the screen along the entire contact edge of said layer to charge the printing screen with ink or dye and to scrape off excess ink or dye, the backing layer being of relatively hard material which is significantly harder than standard doctor blades and which comprises means for elastically biassing said softer doctor blade layer repeatedly back into its original flat condition on removal of pressure from the blade.

* * * * *